US005590559A

United States Patent [19]

Price et al.

[11] Patent Number: 5,590,559

[45] **Date of Patent: *Jan. 7, 1997**

[54] METHOD AND APPARATUS FOR DOMAIN REFINING ELECTRICAL STEELS BY LOCAL MECHANICAL DEFORMATION WITH MULTIPLE SCRIBING ROLLS

[75] Inventors: Leroy R. Price, Allison Park; James G. Benford, Pittsburgh, both of Pa.

[73] Assignee: Allegheny Ludlum Corporation, Pittsburgh, Pa.

[ * ] Notice: The term of this patent shall not extend beyond the expiration date of Pat. No. 5,397,402.

[21] Appl. No.: 379,415

[22] Filed: Jan. 27, 1995

Related U.S. Application Data

[62] Division of Ser. No. 977,595, Nov. 17, 1992, Pat. No. 5,408,856.

[51] Int. Cl.[6] ..... B21B 27/02

[52] U.S. Cl. ..... 72/366.2; 148/111

[58] Field of Search ..... 72/194, 197, 199, 72/201, 365.2, 366.2, 379.6; 148/111, 112, 113, 308

[56] References Cited

U.S. PATENT DOCUMENTS

| | | | |
|---|---|---|---|
| 750,042 | 1/1904 | Worth | 72/197 |
| 1,898,061 | 2/1933 | Otte | 148/111 |
| 3,138,981 | 6/1964 | Werthman | 72/199 |
| 4,533,409 | 8/1985 | Benford | 148/111 |
| 4,711,113 | 12/1987 | Benford | 72/197 |
| 4,711,291 | 12/1987 | Reinhold | 492/47 |
| 4,742,706 | 5/1988 | Sasaki et al. | 72/241.2 |
| 4,770,720 | 9/1988 | Kobayashi et al. | 148/111 |
| 5,080,326 | 1/1992 | Price et al. | 266/103 |
| 5,123,977 | 6/1992 | Price et al. | 148/111 |
| 5,397,402 | 3/1995 | Benford | 148/111 |

FOREIGN PATENT DOCUMENTS

| | | | |
|---|---|---|---|
| 0209740 | 9/1986 | Japan | 72/197 |
| 0198940 | 8/1991 | Japan | 72/197 |
| 1419774 | 8/1988 | U.S.S.R. | 72/366.2 |
| 8600835 | 2/1986 | WIPO | 72/197 |

*Primary Examiner*—Lowell A. Larson
*Assistant Examiner*—Thomas C. Schoeffler
*Attorney, Agent, or Firm*—Patrick J. Viccaro

[57] ABSTRACT

A method and apparatus are provided for refining the domain wall spacing of a grain-oriented silicon steel strip by mechanical scribing and by employing more than one row of staggered small diameter scribing rolls arranged to scribe a different portion of the surface of the strip in a manner that the entire surface of the strip is scribed and in which each row of scribing rolls co-operate with an anvil roll to support the strip.

13 Claims, 5 Drawing Sheets

METHOD AND APPARATUS FOR DOMAIN REFINING ELECTRICAL STEELS BY LOCAL MECHANICAL DEFORMATION WITH MULTIPLE SCRIBING ROLLS

CROSS REFERENCE TO RELATED APPLICATIONS

This is a division of application Ser. No. 07/977,595, filed Nov. 17, 1992, U.S. Pat. No. 5,408,856. This application is related to U.S. patent applications (RL-1610) Ser. No. 08/378,108, filed Jan. 25, 1995, which is a continuation of (RL-1530) Ser. No. 07/977,584, filed Nov. 17, 1992, now abandoned; (BR-1609) Ser. No. 08/378,891, filed Jan. 25, 1995, which is a continuation of (BR-1568) Ser. No. 07/978, 204, filed Nov. 17, 1992, now abandoned; (BR-1608) Ser. No. 08/378,893, filed Jan. 25, 1995, which is a continuation of (BR-1545) Ser. No. 07/977,359, filed Nov. 17, 1992, now abandoned; and (RL-1512) U.S. Pat. No. 5,350,464, issued Sep. 27, 1994; and (RL-1503) U.S. Pat. No. 5,312,496, issued May 17, 1994.

BACKGROUND OF THE INVENTION

1. Field of the Invention

This invention relates to a method and apparatus for improving core loss by refining the magnetic domain wall spacing of electrical sheet or strip products. More particularly, this invention relates to a method of processing final texture annealed grain-oriented silicon steels to permanently refine the domain structure using local hot deformation.

2. Description of the Prior Art

Grain-oriented silicon steel is conventionally used in electrical applications, such as power transformers, distribution transformers, generators, and the like. The steel's ability to permit cyclic reversals of the applied magnetic field with only limited energy loss is a most important property. A reduction of this loss, which is termed "core loss", is highly desirable in the aforesaid electrical applications.

In the manufacture of grain-oriented silicon steel, it is known that the Goss secondary recrystallization texture, (110)[001] in terms of Miller's indices, results in improved magnetic properties, particularly permeability and core loss over non-oriented silicon steels. The Goss texture refers to the body-centered cubic lattice comprising the grain or crystal being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon; casting the melt; hot rolling; cold rolling the steel to final gauge typically of 7 or 9 mils, and up to 14 mils with intermediate annealing when two or more cold rollings are used, or no intermediate annealing for certain high permeability silicon steels; decarburizing the steel; applying a refractory oxide base coating, such as a magnesium oxide, to the steel; and final texture annealing the steel at elevated temperatures in order to produce the desired secondary recrystallization and purification treatment to remove impurities such as nitrogen and sulfur. The development of the cube-on-edge orientation is dependent upon the mechanism of secondary recrystallization wherein, during recrystallization, secondary cube-on-edge oriented grains are preferentially grown at the expense of primary grains having a different and undesirable orientation.

As used herein, "sheet" and "strip" are used interchangeably and mean the same unless otherwise specified.

It is also known that through the efforts of many prior art workers, cube-on-edge grain-oriented silicon steels generally fall into two basic categories: first, regular or conventional grain-oriented silicon steel; and second, high permeability, grain-oriented silicon steel. Regular, grain-oriented silicon steel is generally characterized by a permeability of less than 1870 at 10 Oersteds. High permeability, grain-oriented silicon steels are characterized by higher permeabilities which may be the result of composition changes alone or together with process changes. For example, high permeability silicon steels may contain nitrides, sulfides, selenides, and/or borides which contribute to the particles of the inhibition system which is essential to the secondary recrystallization process for the steel. Furthermore, such high permeability silicon steels generally undergo greater cold reduction to final gauge than regular grain oriented steels. A heavy final cold reduction on the order of greater than 80% is generally made in order to facilitate the high permeability grain orientation. While such higher permeability materials are desirable, such materials tend to produce larger magnetic domains than conventional material. Generally, larger domains are detrimental to core loss.

It is known that one of the ways that domain size and thereby core loss values of electrical steels may be reduced occurs when the steel is subjected to any one of various practices designed to induce localized strains in the surface of the steel. Such practices may be generally referred to as "domain refining by scribing" and are performed after the final high temperature annealing operation. If the steel is scribed after the final texture annealing, then a localized stress state in the texture-annealed sheet is induced so that the domain wall spacing is reduced. These disturbances typically are relatively narrow, straight line patterns, or scribes, generally spaced at regular intervals. The scribe lines are substantially transverse to the rolling direction and typically are applied to only one side of the steel.

In fabricating electrical steels into transformers, the steel inevitably suffers some deterioration in core loss quality due to cutting, bending, and construction of cores during fabrication, all of which impart undesirable stresses in the material. During fabrication incidental to the production of stacked core transformers and, more particularly, power transformers in the United States, the deterioration in core loss quality due to fabrication is not so severe that a stress relief anneal (SRA), typically about 1475° F. (801° C.), is essential to restore properties. For such end uses, there is a need for a flat, domain-refined silicon steel which need not be subjected to stress relief annealing. In other words, the scribed steel used for this purpose does not have to possess domain refinement which is heat resistant.

However, during the fabrication incidental to the production of most distribution transformers in the United States, the steel strip is cut and subjected to various bending and shaping operations which produce more working stresses in the steel than in the case of power transformers. In such instances, it is necessary and conventional for manufacturers to stress relief anneal (SRA) the product to relieve such stresses. During stress relief annealing, it has been found that the beneficial effect on core loss resulting from some scribing techniques, such as mechanical and thermal scribing, are lost. For such end uses, it is required and desired that the product exhibit heat resistant domain refinement (HRDR) in order to retain the improvements in core loss values resulting from scribing.

In referring now to certain prior teaching, U.S. Pat. No. 4,533,409, issued Dec. 19, 1984 and U.S. Pat. No. 4,711,113, issued Dec. 8, 1987, disclose a method and apparatus for scribing a grain-oriented silicon steel to refine the grain structure by passing the cold strip through-a roll pass defined by an anvil roll and scribing roll having a surface with a plurality of projections extending along and generally parallel to the roll axis. The anvil roll is typically constructed from a material that is relatively more elastic than the material from which the scribing roll is constructed. Preferably, the scribing roll is constructed from steel and the anvil roll is constructed from rubber. The process described in U.S. Pat. No. 4,711,113, may be performed before or after final texture annealing but the domain refinement achieved is not maintained through the usual stress relief annealing temperatures.

U.S. Pat. No. 4,742,706, issued May 10, 1988, discloses an apparatus for imparting strain to a moving steel sheet at linear spaced-apart, deformed regions. The apparatus includes a strain imparting roll having a plurality of projections as in the above described U.S. Pat. No. 4,711,113, except that the projections are formed on a spiral relative to the axes of rotation of the roll. The apparatus of the '706 patent also includes a press roll, a plurality of back-up rolls and a fluid pressure cylinder interconnected so as to control pressure against the press roll.

U.S. Pat. No. 4,770,720, issued Sep. 13, 1988 discloses a cold deformation technique wherein final texture annealed grain oriented silicon steel at as low as room temperature, and as high as from 50° C. to 500° C. (122° F. to 932° F.) is subjected to local loading, at a mean load of 90 to 220 kg/mm$^2$ to (127,000 to 325,000 PSI) to form spaced apart grooves. The sheet must then be annealed at 1380° F. (750° C.) or more so that fine recrystallized grains are formed to divide the magnetic domains and improve core loss values which survive subsequent stress relief annealing.

In U.S. Pat. Nos. 5,080,326, issued Jan. 14, 1992 and U.S. Pat. No. 5,123,977, issued Jun. 23, 1992 and assigned to the same assignee of this patent application, a hot deformation technique is disclosed wherein the steel sheet is heated to a temperature in the range of 1200° F. to 1500° F. (648° C. to 816° C.) and while in this state it is locally hot deformed to facilitate the development of localized fine recrystallized grains in the vicinity of the areas of localized deformations to effect heat resistant domain refinement and core loss.

In pending U.S. application Ser. No. 08/378,108, filed Jan. 25, 1995 and assigned to the same assignee of this patent application the use of a very hard surface anvil or press roll is disclosed having a hardness that will prevent excessive penetrations of the scribes in the steel strip and allow controlling of the degree of such penetrations to maintain high stacking factor.

While the above prior attempts have, to different degrees, met the basic objectives to which they were addressed, they have created other technical and practical problems which the present invention is designed to overcome. One such problem is the stacking factor of the core assembly of the transformer. The stacking factor has reference to the important interest in being able to stack a maximum number of scribed sheets in a given cross section which are used to make up a transformer core assembly. This criterion is addressed to the capacity or power rating and size of the transformer and hence its ultimate use and cost. The stacking dimension is "enlarged" by the degree of penetration of the localized deformations cause by scribing and the non-uniformity in a linear direction of the deformations, (i.e. variation in the depth of the deformations). These two conditions of non-uniformity and excessive penetration of some of prior deformation techniques are also objectionable because they create problems in operation of the core-winding machine and gap patterns of the elements of the core and in the ease of moving and manipulating the scribed sheets during processing in the manufacturing of the transformers.

Another problem possessed by some of the prior scribing practices employing spiral scribing projections is the adverse influence such systems have on forcing the moving strip out of its desired path of travel during scribing and the permanent twist that is imposed in the strip. Such strip movement is some times hereinafter referred to as "tracking" or "wandering". In the first case, the misdirected or wandering strip causes the reduction of strip feeding speed and in some instances, interruption of the process and in the other, unwinding and handling difficulty in processing the scribed strip during the manufacture of the transformers.

Another problem with the prior mechanical scribing systems is the high inertia inherently represented by the single large diameter scribing or strain rolls and the high loading pressures such rolls necessitate to effect the desired local deformation. Such roll design, in addition to creating the aforesaid strip tracking condition, also tends to tear the strip, at elevated temperatures. The high loading pressures and temperatures cause objectionable thermal distortion of both the strain roll and the anvil roll and substantial deflection of the latter.

The present invention provides a new method and apparatus for overcoming each of the above enumerated problems, difficulties and objections.

SUMMARY OF THE PRESENT INVENTION

In accordance with the present invention, a method and apparatus are provided for refining the domain wall spacing of a grain-oriented silicon steel sheet by mechanical scribing, wherein a scribing roll system is provided comprising at least two separate relatively small diameter scribing rolls arranged to co-operate with an anvil or press roll that may comprise a single roll for two or more separate scribing rolls or separate rolls for each scribing roll. This system may be used for scribing silicon steel at elevated temperature or at relatively colder conditions.

Preferably, the scribing rolls are arranged in a staggered pattern in two or more rows relative to the path of travel of the strip, wherein in each row the rolls are spaced apart a distance approximately equal to the length of an adjacent roll of the other row, which is located in the space so that the entire width of the strip is scribed in alternate longitudinal scribed fields. The scribing rolls may be provided with a chevron tooth pattern and have individual support arms and loading mechanisms so that they may be selectively positioned relative to the passing strip and each other and their individual loads controlled to obtain the desired depth and uniformity of deformation without adverse effect from strip wandering and thermal crowning.

In accordance with the present invention, a method and apparatus are provided for improving the core loss of grain oriented silicon steel by domain refining with a chevron pattern of scribing. Rotatable scribing and anvil roll means are provided to cooperate to impart mechanical scribing on one entire surface of strip. Scribing roll means imparts local deformations in the strip by projections on the outer periphery of the scribing roll. Multiple chevron patterns in predetermined relatively closely spaced relation are formed across the width of the strip with the locus of points formed by the apex of the chevron pattern aligned in the rolling direction of the strip.

BRIEF DESCRIPTION OF THE DRAWINGS

The above and other objects and features of the invention will become more apparent from the following detail description taken in connection with the accompanying drawings which form a part of this specification and in which.

DETAILED DESCRIPTION OF THE INVENTION

Figure 1:
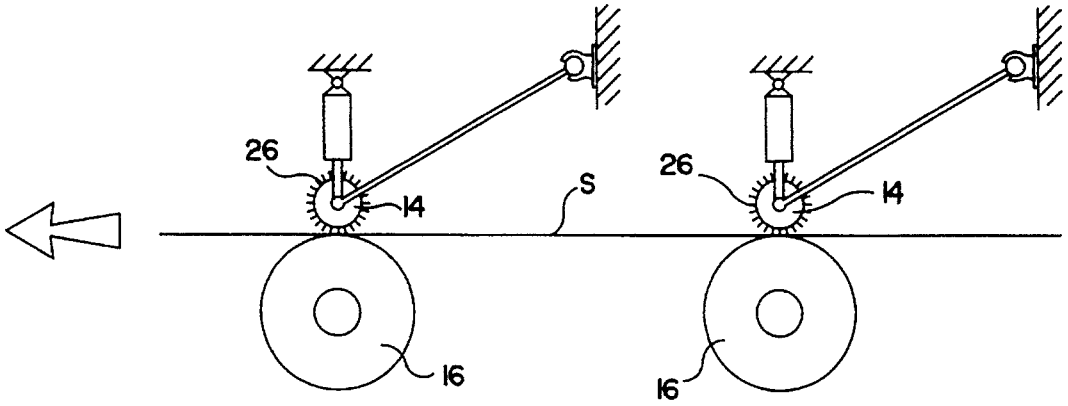
FIG. 1 is a schematic view of one form of the present invention illustrating two rows of scribing and anvil rolls.
Figure 2:
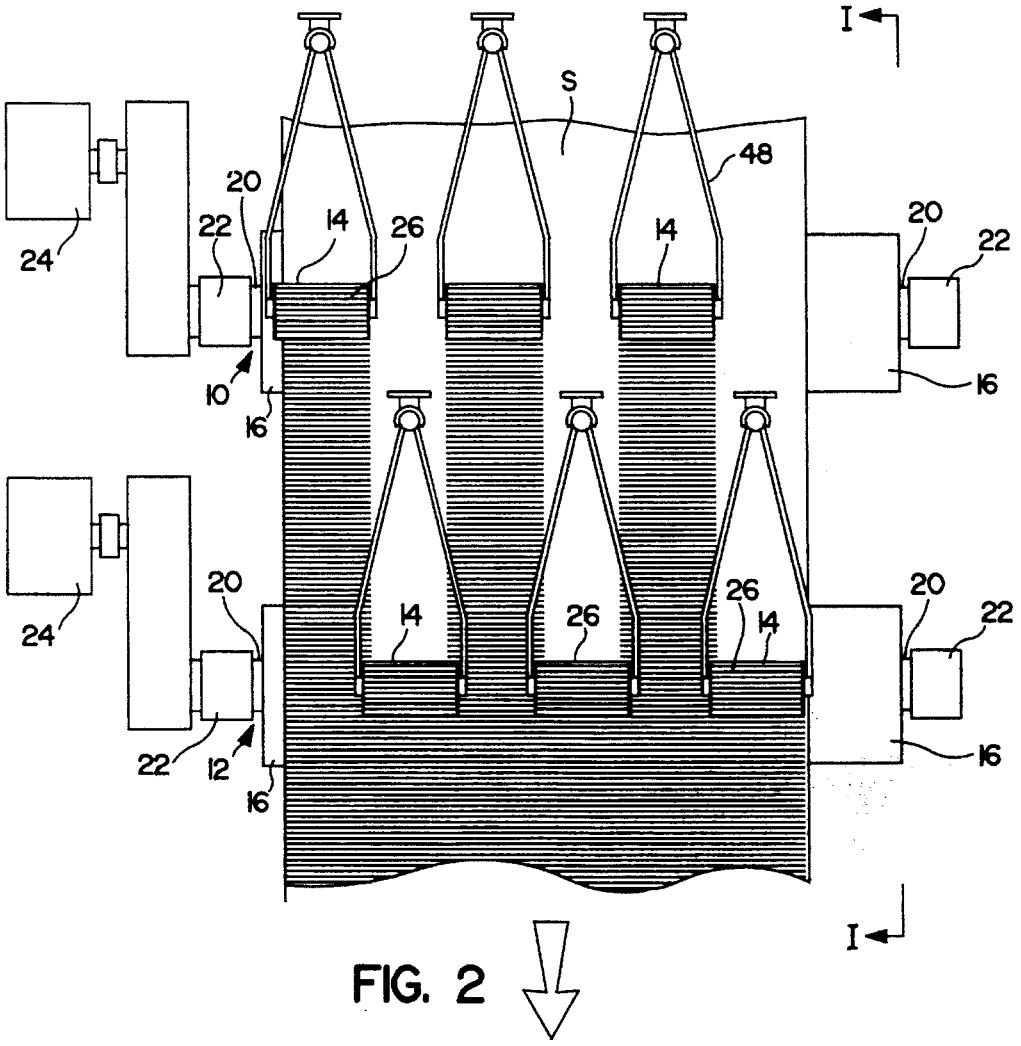
FIG. 2 is a plan view of FIG. 1.

With reference to FIGS. 1 and 2, there is illustrated a method and apparatus for refining the domain structure of electrical steels by local mechanical deformation whether the steel is at elevated temperature or not. As shown, there are two rows, 10 and 12, of identical low inertia rolls 14 which are staggered such that the initial most row having four evenly spaced apart rolls 14 and downstream thereof are three evenly spaced apart rolls 14. As shown in FIG. 2, the rolls 14 of each row are spaced apart a distance approximately equal to the axial lengths of the rolls of the other row, thereby the rolls of both rows cover the entire width of the strip to be scribed, the strip being shown in both FIGS. 1 and 2 is marked with the legend S. The length of each roll 14 may range up to about one-half the strip width. Each scribing roll may be on the order of 1 to 22 inches (2.5 to 55.9 cm) long. Arrows also are shown in these figures to indicate the direction of travel of the strip, which is from right to left as one views FIG. 1 and top to bottom as one views FIG. 2.

Directly below the scribing rolls 14 of each row 10 and 12 there are arranged identical anvil or press rolls 16, the rotational axis of rolls 16 extending parallel to the rotational axes of the rolls 14 thereabove and have their axes co-planar with the associated scribing rolls. The anvil rolls are adapted to serve as rigid resistant members for the scribing rolls as the strip is fed between the cooperative set of rolls and the scribing rolls are urged against the strip to effect the desired local mechanical deformation in the upper surface of the strip in a manner generally well known in the art.

In the embodiment illustrated in FIGS. 1 and 2, the rolls 14 are idler rolls which rotate by the frictional contact with the constantly moving strip. The strip is advanced between the rolls by a strip driving means, such as one or more well known pinch roll units, not shown. The strip speed is within the range of approximately 20 to 400 feet per minute (6 to 92 meters per minute). The freedom of the rolls 16 to rotate is accomplished by providing a support shaft 20 extending from opposite ends of the rolls and rotatably supported in bearing units 22 mounted in a well known manner, not shown. In some application of the invention, either or both of the rolls 14, and 16 may be directly driven either to advance the strip through the roll units or, if the strip is moved by other means, to match the roll speed with the strip speed.

Figure 3:
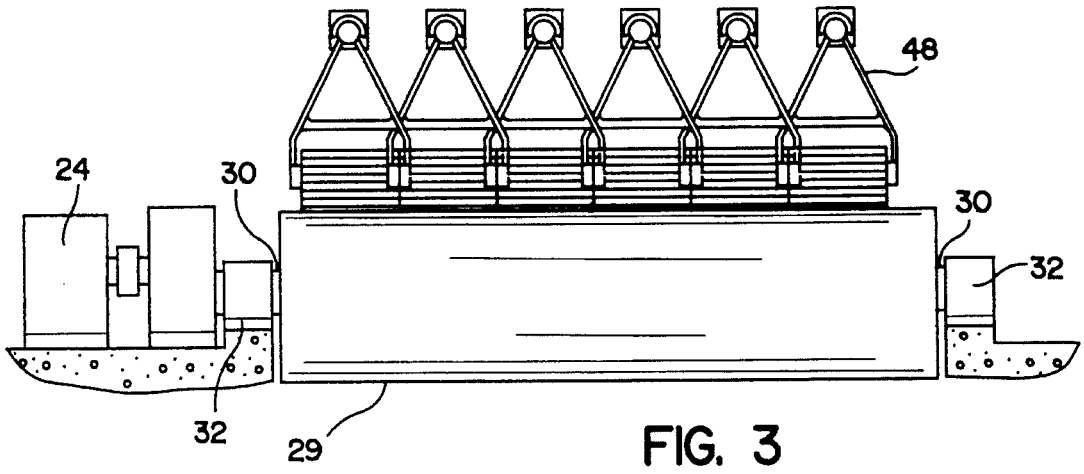
FIG. 3 is an elevational view of the anvil rolls, scribing rolls and associated structure shown in FIG. 1.

In the arrangement shown in FIGS. 2 and 3, the anvil rolls are positively driven by motor-gear drive units 24. One of the considerations as to whether the rolls are directly driven or not will be whether the strip is in a heated condition or cooler, such as at room temperature. In the heated condition the yield strength of the strip may be greatly reduced resulting in a danger that the inertia of the rolls may tear or otherwise damage the strip or cause the forming of non-uniform scribes during the scribing.

Figure 4A:
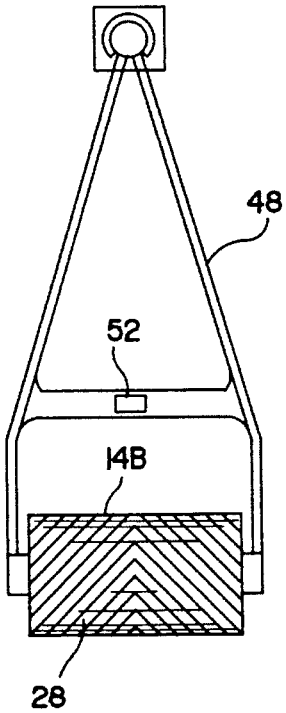
FIG. 4A and 4B are an enlarged plan views of a scribing roll illustrating a chevron scribing pattern.
Figure 4B:
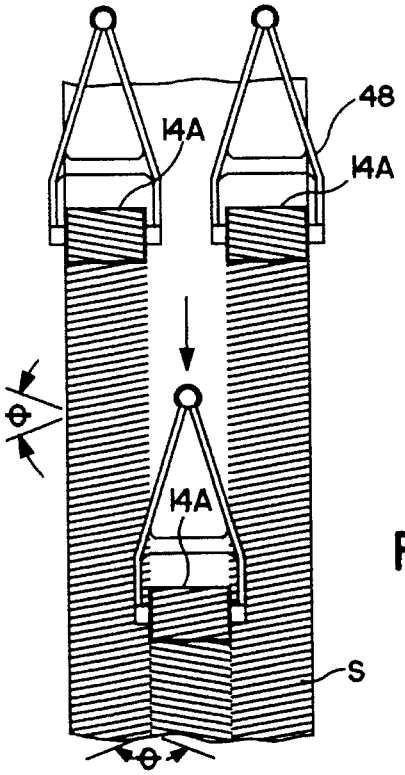

Each of the scribing rolls 14 is provided with strip deforming projections that may take several different forms as noted in the aforesaid prior issued patents. FIG. 2 illustrates that the scribing rolls 14 have formed on their outer peripheries spaced apart parallel, axially extending teeth-like projections 26 that extend the full length of the rolls. The degree of spacing and other dimensions of the projections may follow the teaching of the aforesaid patents. In another embodiment, the projections may be as shown in FIG. 4A, where the projections in the body of scribing roll 14A are in the form of a chevron pattern of scribing ridges 28 extending to the opposite ends of the scribing roll 14A. Furthermore, the apexes of the chevrons fall in a substantially common plane at approximately the axial longitudinal center of the scribing roll 14A. The scribing ridges 28 are spaced apart between 1 and 15 mm, preferably between 2 and 10 mm and extending across the face surface of each of the scribing rolls. The pitch or spacing of the scribing ridges as measured between the valleys or scribed grooves defining two adjacent projections may be on the order of 2 to 10 mm, preferably about 5 mm, and have a depth on the order of 0.5 to 1.0 mil. The groove formed by each scribing surface 28 is 45° or less and can have an angle between 10° to 20°. As shown in FIG. 4B, the helical arrangement of ridges formed by the side-by-side arrangement of the scribing ridges produces on the surface of the strip as a result of the scribing operation pattern, scribed lines that are angled an angle, θ, of 45° or less preferably between 20° and 10° from the perpendicular to the strip rolling direction shown by the arrow in FIG. 4B. The arrangement of the scribed marks caused by the adjacent patterns on segments form an included angle of at least 90°, preferably in the range of 90° to 160° and form a chevron pattern of scribe lines on the strip across the entire width of the strip.

In an alternative embodiment of FIG. 4B, a chevron pattern may be scribed on the steel strip by the alternating orientation or arrangement of staggered scribing rolls 14B. Particularly, the chevron pattern is formed by the lead of the helical arrangement of ridges which merge at the center of the roll. An angle is formed between the projecting ridges scribed by the adjacent staggered scribing roll 14. In this embodiment, the projections of at least every other staggered scribing roll 14B would extend axially at an angle from end-to-end of roll 14. Preferably, the projections of each staggered scribing roll 14 would be at such an angle in alternating directions as shown in FIG. 4B.

The chevron projections are spaced apart a distance within the range of 1 to 15 mm in order to impose local compressive forces or stresses on a strip surface as scribe lines at intervals of about 2 to 12 mm. Preferably, the spacing is 5 to 10 mm between projections. The pitch of the projections as measured between the valleys or grooves scribed defining two adjacent projections may be on the order of 2 to 1.0 mm, preferably about 5 mm, and have a depth on the order of 0.5 to 1.0 mil. The scribe projections extend from each side of the roll to a point where they merge and fall within a central plane transverse to the rotational axis of the roll.

The included angle $\phi$ formed by the chevron may range from 90° to 180° and preferably range from 140° to 160°. An angle, $\theta$, is provided for scribe lines in the strip from corresponding projections in the scribing roll 14 of 10° to 20° from the perpendicular to the rolling direction.

It has also been found that chevron patterns with smaller legs pitch tend to provide further improvement in core loss values over larger chevrons. By smaller legs, it is meant that the oblique lines of the chevron are shorter, and do not extend to the end of the scribing roll, such as shown in FIG. 4B. In such embodiments, two or more chevrons are provided on a scribing roll 14 such that the oblique lines or legs of the chevron may range from 0.5 to 22 inches long, preferably about 0.5 inch. Such multiple chevrons (not shown) would provide a zig-zag pattern on each scribing roll 14 or 14A.

Such chevron patterns provide at least three advantages over typical mechanical scribe lines which extend substantially across the width of the sheet strip transverse to the rolling direction. First, there appears to be an improvement in maintaining the track of the strip as it passes between the scribing rolls and the anvil rods. A tendency of the strip to "drift" or shift laterally in the plane of the sheet was observed when providing mechanically scribing that extends substantially across the strip width from edge to edge. The chevron patterns appear to minimize tracking problems.

Second, there is a further improvement in core loss reductions by 5 to 10 milliwatts per pound (mwpp) at 60 Hz and 1.5T. over typical scribing which has scribe lines extending substantially across the width of the sheet strip.

Third, there appears to be an improvement in handling characteristics of the scribed material during core winding operations for the transformer manufacturer. The chevron patterns appear to provide fewer winding and lacing difficulties, perhaps as the result of the absence of unidirectional scribe lines that may induce lateral thrust. Such improved winding and lacing results in improved gap patterns and higher stacking factors.

The scribing rolls 14 may be made out of known materials and 1040 carbon steel having a Rockwell A ($R_A$) hardness of 55 or high-speed tool steel having an $R_A$ of 60. The anvil rolls 16 in the preferred form should be much harder than the projections of the scribing roll, for example, the hardness of a tungsten carbide material with $R_A$=90. All the rolls 14 and 16 must be inherently constructed to be rigid and, in addition, be supported to provide a very rigid assembly, one that will not unduly defect under the range of working loads needed to process the different steel types, desired widths and degree of scribing penetrations. This is particularly true of the anvil roll, which may be made as a solid steel roll having an outer surface which is harder and more rigid or of a hub-sleeve construction, depending on the particular application, and in any case having a substantial resistance to deflection under the scribing loading, as described in copending U.S. application (RL-1610) Ser. No. 08/378,108, filed Jan. 25, 1995.

The final design of the anvil roll to a certain extent will depend on the total loading or pressure required to effect the desired penetration of the scribes. To a great extent this will depend on whether a full length roll is employed or whether one or more short length or body rolls is used, as shown in FIG. 3, and if the strip being scribed is hot or cold, as taught by the prior art. In FIG. 3, there is shown the use of separate anvil rolls 29 for each strain roll 14. If desired, the anvil roll can serve as a press roll for a pair of the scribing rolls of the row 10. The ends of the separate anvil rolls 29 will be rotatably supported by well known bearing units, two of the ends being shown at 30 and their bearing units at 32.

Figure 5:
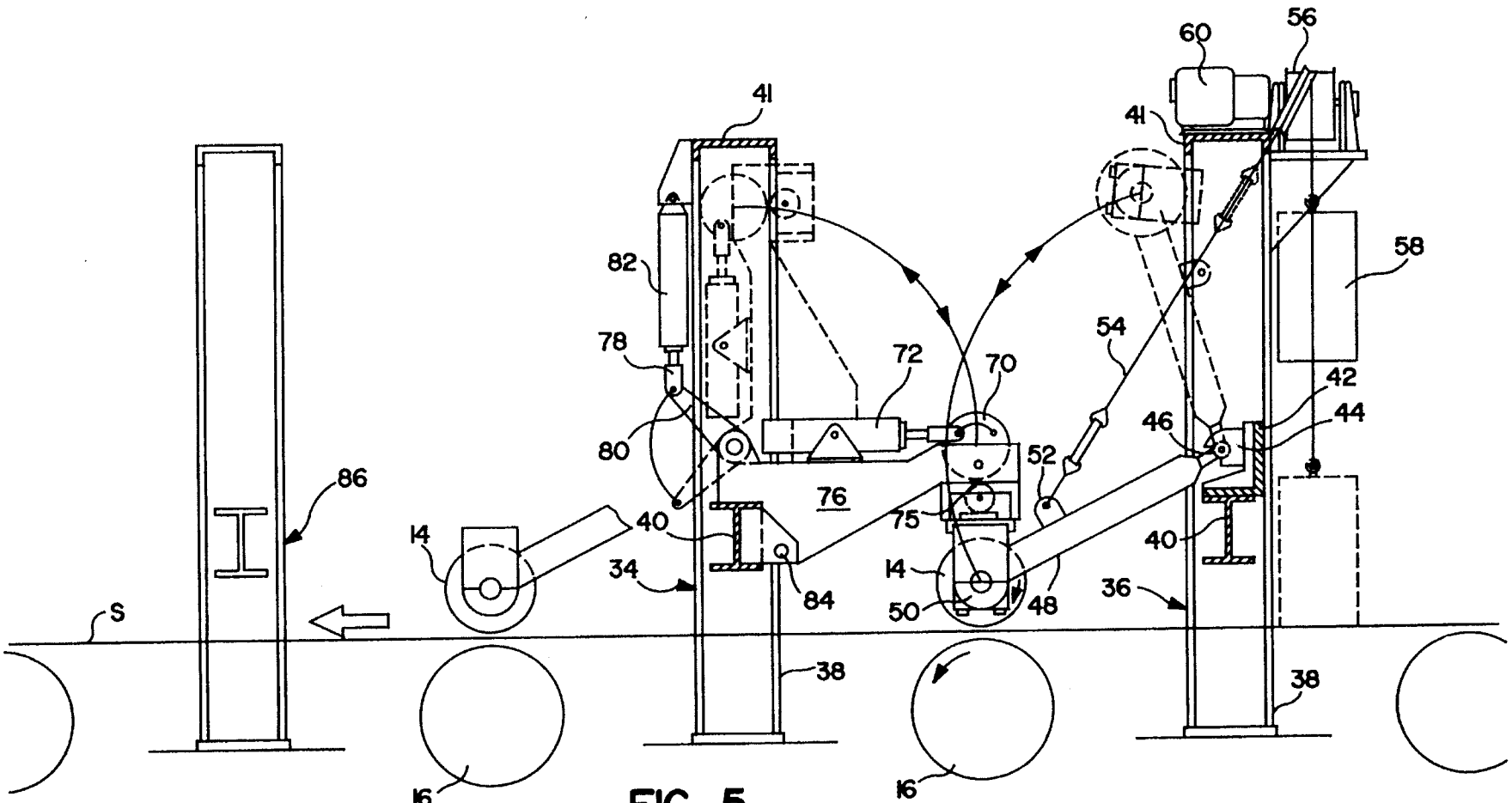
FIG. 5 is an enlarged side view of the pivotal support arm and mechanism for applying the loading to one of the scribing rolls.

With reference to FIG. 5, there is shown the support and load applying mechanism for one of the scribing rolls 14, it being understood that each scribing roll could have an identical mechanism; the support includes a pair of upright, spaced apart frames 34 and 36. Each of the frames 34 and 36 includes upright post members 38 mounted on suitable foundation supports at opposite sides of the strip S. The post members are interconnected by a horizontally arranged carrier beam 40 and by a channel section 41 at the tops of the posts. The carrier beam 40 supports an upstanding bracket 42 at each of the spaced apart locations to anchor a ball and socket anchor assembly for a scribing roll. For this purpose, bracket 42 supports a housing 44 having an internal spherical cavity therein for receiving a ball portion 46 on one end of a support yoke or pivot arms 48. The ball and socket anchor assembly allows the yoke freedom of motion to allow tracking and uniform pressure of the scribing roller on the strip. As shown, yoke 48 is bifurcated to thereby form spaced apart arms that are connected to bearing blocks 50 that rotatably support journals extending from opposite sides of a scribing roll 14.

Although a ball joint is shown and described, other joint arrangements, such as articulated or compound joints, may be suitable provided that a fully independent two dimensional range of motion in a plane and between planes is achieved. As used herein, the term "ball-joint" shall mean such a joint.

By this construction the roll 14 may be maintained in an operative "straight" or "tilt" position, i.e. in a position where its axis is skewed end to end in the horizontal or vertical directions, as one views FIG. 1. In this manner the roll 14 can be selectively positioned to assist in guiding the strip S and in obtaining uniform penetration of the scribes.

The yoke 48 is provided with an eye 52 to which is secured a cable 54 of a hoist mechanism, the cable running to a pulley-drum unit 56 and hence to a counterweight 58. The drum is driven by a motor 60 to raise the roll 14 for maintenance purposes to the position shown in dash lines in FIG. 5. The hoist assembly is designed to serve all of the rolls 14 of the particular row 10 or 12 (as shown in FIG. 2) in which each roll is provided with a cable and pulley.

The loading force or working pressure for each strain roll 14 is furnished by a separate eccentric cam roller 70 rotatably mounted above the roll 14, and being eccentrically positionable by an electric cylinder assembly 72 to adjust the loading force on the roll 14. Interposed between the roll 14 and the roller 70 is a load cell unit 74 of a well known type for producing an electrical signal of the individually applied loads. The load cell unit 74 includes a roller 75 that contacts the cam roller 70 and is mounted on and carried by the frame 76. The cam roller 70 is rotatably carried in a frame 76 constructed to pivot on the frame 34.

To the frame 76 there is connected the piston end 78, through a lever 80, of a piston cylinder assembly 82 which on operation raises the frame 76, the roller 70 and load cell 74 to an inoperative position such as shown in dash lines to allow maintenance access to the scribing roll 14. The frame 76 is provided with a removable locking pin 84 to hold the frame in its operative position. In FIG. 5, a third upright frame 86 is shown for the scribing rolls 14 of the row 12 which will utilize the frames 34 and 86 for the support and load applying mechanism for its rolls 14.

Figure 6:
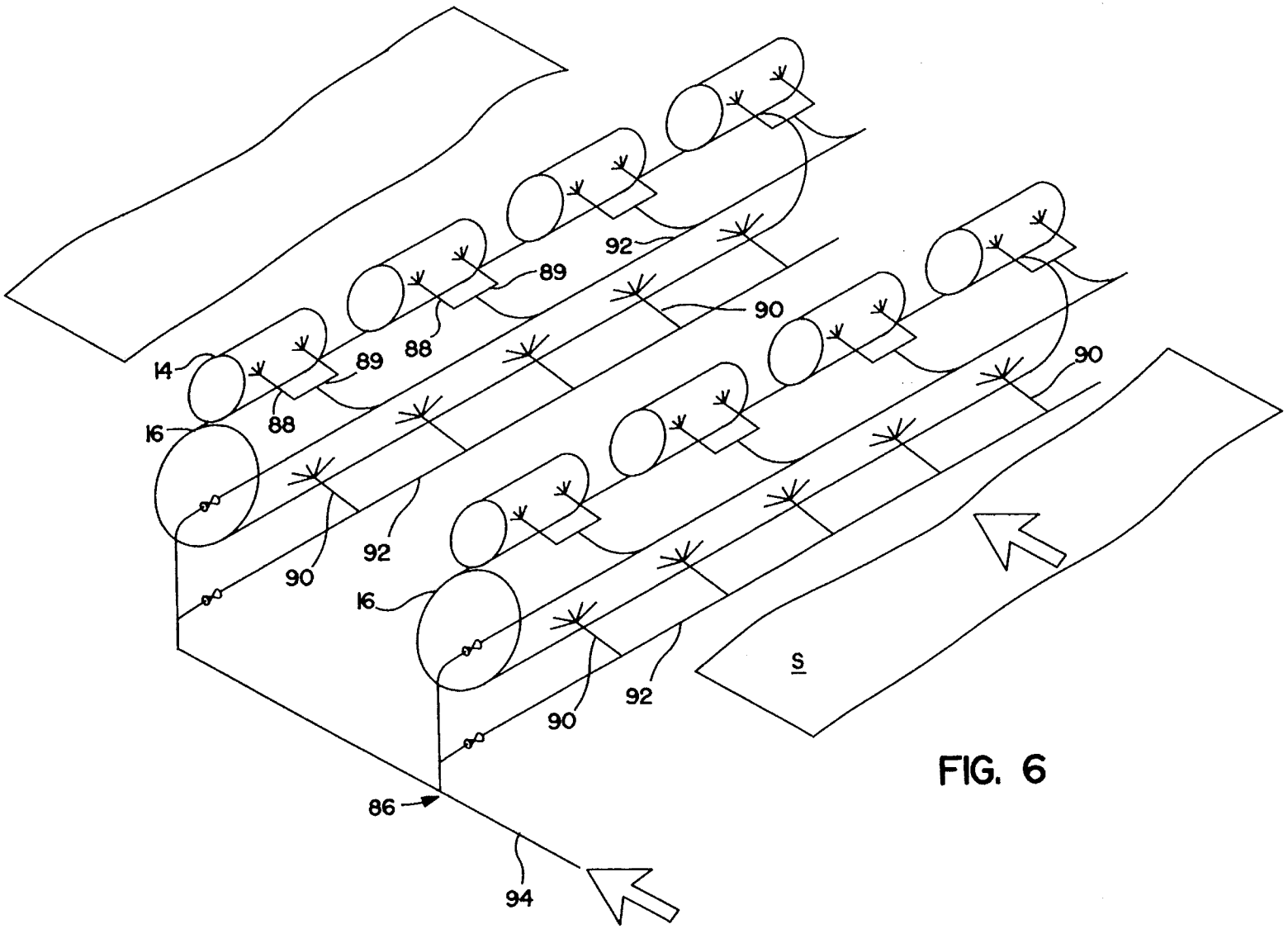
FIG. 6 is a schematic view of a crown control system for the scribing and anvil rolls shown in FIG. 1.

Depending on the type of roll design selected for the scribing rolls 14 and anvil rolls 16 and 29, and whether the process is a hot strip scribing process, it may be desirable to provide a crown control system to minimize the differential enlargement of the diameter or crown of the rolls from end to end due to thermal expansion. This condition may adversely affect the uniformity of penetration of the scribes and the ability to keep the moving strip in the desired path of travel. In FIG. 6 a crown control system is schematically illustrated comprising a water spray system 86, which includes for each scribing roll 14 two spaced apart sprays 88 and for each anvil roll 16 four equally spaced sprays 90.

The sprays 88 and 90 are supplied cooling water at room temperature by a hose-pipe network 92 which receives the water from a common source 94. If desired, a mixture of water and air can be used. The pressure and/or volume of coolant and the application to selected rolls can be controlled to give a desired control of the thermal crown expansion of the individual rolls 14 and/or 16. Such control system, as is true of the associated components described, may follow well known teaching in the art.

Figure 7:
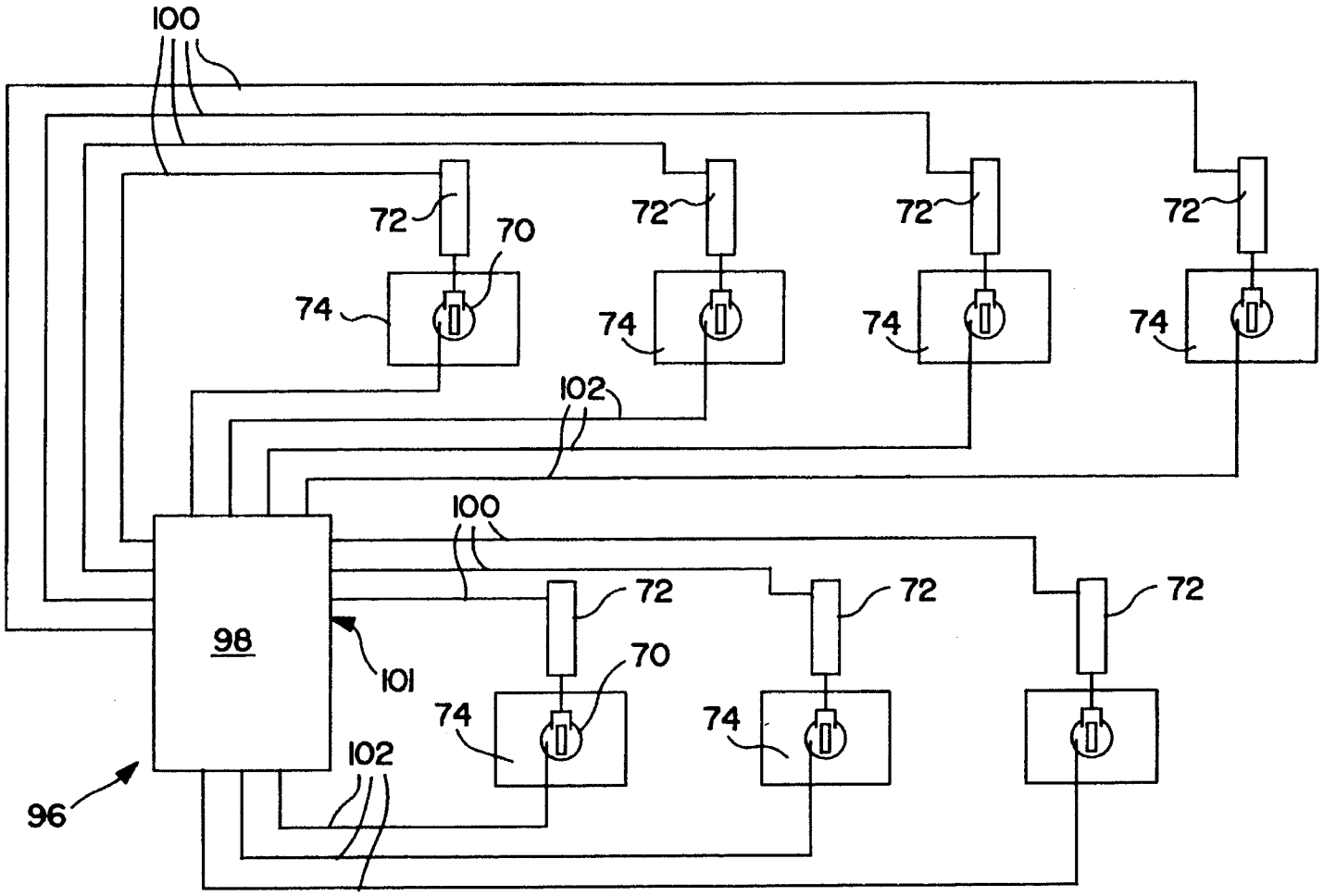
FIG. 7 is a schematic view of a loading control system for each scribing roll shown in FIG. 1.

In FIG. 7, there is illustrated a roll loading or applied pressure control system 96 for the scribing rolls 14 of both rows 10 and 12 that permits the load applied by each roll to be individually selected, determined and controlled. This system comprises, for each load applying electric cylinder 72 for each scribing roll 14 and its associated cam roller 70 and load cell 74, an electrical controller 98 to which is connected a series of electrical lines 100 for sending signals, indicated at 101, of selected pressure values to each electric cylinders 72. Lines 102 provided the controller 98 with signals from the load cells 74 of the actual applied loads. If the two signals for any one of the rolls do not match, the controller 98 will produce an error signal which it will use to change the cylinder force until it applies the correct load for that roll. The controller 98 may take the form of several well known heavy duty industrial type process controllers, such as a model by General Electric, Corp.

In briefly describing the operation of the present invention, its employment in the hot scribing technique will be referred to employing a chevron type scribing roll 14, as herein disclosed, where the anvil rolls 16 of FIGS. 1 and 2 are driven at a desired speed to advance the strip S to be scribed at a substantially linear speed of approximately 100 fpm. The fact that a number of small diameter and short length scribing rolls are employed when working with hot strip having a temperature of 1000° F. to 1400° F. (540° C. to 760° C.) will substantially reduce the danger of the strip being pulled apart by the inertia of the rolls and allow the strip to be formed with uniform and controlled depth of local penetrations of the scribes. The use of multi-rolls will also lessen strip wandering and allow for correction at desired operating line speeds by positioning, for example, the two outer scribing rolls 14 of rows 10 and 12 to urge the moving strip to the center of the desired path of travel. An improvement in strip tracking will also be enhanced by the chevron teeth design 28 of the scribing projections, since in employing this form of projections there will be less tendency of the projections to bias or urge the strip to the left or right of the desired path of travel.

As each portion of the strip S is caused to pass through the pressure zone formed by a set of scribing and anvil rolls 14 and 16, the several longitudinal parallel fields of the strip will be scribed, as indicated in FIG. 2. During this working, the loading of the individual scribing rolls 14 as applied by their respective electric cylinders 72 and as individually controlled by the process controller 98 will cause, if necessary, the rolls 14 to apply the necessary loading to bring about a uniform and controlled depth of scribing in each of the fields, or if desired a controlled non-uniform scribing. The operating or working pressures will be indicated by the load cells 74, in which individual pressure signals will be sent to the process controller 98 to control, for example, selectively vary the pressures of the cylinders 72, if necessary.

The providing of the very hard surface anvil roll, and one that is very rigid will assist in assuring that the penetrations will be maintained within the desired limits to obtain the highest possible stacking factor. The individual scribing rolls 14 through the positioning of the support yokes 48 can be angularly oriented relative to the moving strip to assist in maintaining the strip in its desired path of travel. When the strip being processed is in a heated condition, the crown of either or both of the scribing rolls 14 and anvil rolls 16, or 29 can be controlled by the controlled application of water by the crown control system 86.

The segmented scribing roller disclosed in pending U.S. patent application (BR-1609) Ser. No. 08/373,891, filed Jan. 25, 1995, and assigned to the same assignee as this patent application, can be used to scribe a surface of the strip while supported by a solid anvil roll to carry out the method and obtain the strip product according to the present invention. The segmented scribing roller offers the advantage of providing uniform scribing pressure by the use of an arbor used to support inflatable bladders that apply uniform pressure or support of segments. The segments rotate about an axis and each have scribing surfaces contacting the strip for the scribing operations. It being necessary, however, to form the scribing surfaces so as to produce the requisite Chevron pattern as shown and described herein.

The segmented anvil roller disclosed in pending U.S. patent application (BR-1608) Ser. No. 08/378,893, filed Jan. 25, 1995, and assigned to the same assignee as this patent application, can be used to support the strip during scribing by any one of a variety of scribing roll patterns and roll constructions described herein. The segmented anvil roller offers the advantage of providing uniform support for the strip while contacted at the opposite face by a scribing roller having scribing surfaces arranged to produce the requisite Chevron pattern shown and described herein.

Although the invention has been shown in connection with certain specific embodiments, it will be readily apparent to those skilled in the art that various changes can be made to suit particular requirements and conditions without departing from the spirit and scope of the invention.

What is claimed is:

1. A method for improving core loss of a grain-oriented silicon steel strip comprising the steps of:

causing different portions of the strip to be contacted by at least two rotatable scribing roll means arranged across one side of the strip, subjecting the said side of the strip to pressure contact with projections formed on peripheral surfaces of said scribing roll means to impart mechanical scribing to said different portions of the strip as the strip is advanced passed said scribing rolls means, supporting the strip, while being scribed, by rotatable anvil roll means arranged to contact and support the side of the strip opposite said one side thereof, in which said anvil roll means possesses substantially greater resistance to deflection than said scribing roll means during the scribing.

2. A method according to claim 1, the additional steps of scribing the strip in at least two rows of spaced apart similar scribing rolls, axes of said rolls of each row being substantially co-axially arranged, and arranging said scribing rolls of one row in a staggered relationship with respect to the spacing of the scribing rolls of another row in a manner to impart said scribing to substantially the entire strip width.

3. A method according to claim 2, the additional step of mounting each scribing roll on a fully independent ball joint, and wherein said scribing rolls have lengths substantially less than the width of the strip.

4. A method according to claim 2, wherein said step of supporting the strip by said anvil roll means, includes supporting the strip by separate anvil rolls for a set of said scribing rolls of each said row.

5. A method according to claim 4, the additional step of driving said anvil rolls.

6. A method according to claim 1, wherein the step of subjecting the strip to contact with said projections includes arranging said projections in a predetermined spaced apart relation and extending parallel to axes of said scribing roll means.

7. A method according to claim 1, wherein said step of supporting the strip by said anvil roll means includes supporting the strip by separate anvil roll means for at least two said scribing roll means.

8. A method according to claim 1, the additional steps of causing the strip to move between said scribing roll means and said anvil roll means, maintaining at least one of said scribing roll means in a selected orientation relative to said side of the strip to be scribed in a manner to enhance in guiding the strip during its movement and in obtaining a desired scribing effect by said at least one scribing roll means.

9. A method according to claim 1, including the additional step of applying a selective loading to at least one of said scribing roll means in a manner to enhance obtaining the desired scribing effect.

10. A method according to claim 9, wherein said step of applying said loading includes selectively controlling said loading applied to said scribing roll means.

11. A method according to claim 1, the additional steps of scribing the strip in a heated condition and cooling said anvil roll means or scribing roll means or both to reduce thermal radial expansion of either said roll means.

12. A method according to claim 11, wherein said step of cooling includes the step of applying coolant to said scribing roll means or anvil roll means or both and controlling said application of coolant in a manner to control the thermal radial expansion of said scribing and anvil roll means.

13. A method for improving core loss of a grain-oriented silicon steel strip comprising the steps of:

causing different portions of a heated strip to be contacted by rotatable scribing rolls arranged relative to the strip in at least two rows of spaced apart similar scribing rolls, axes of said scribing rolls of each row being substantially co-axially arranged, and wherein said scribing rolls of one row are in a staggered relationship with respect to said spacings of the scribing rolls of another row in a manner to impart said scribing to substantially the entire strip width, subjecting the said side of the strip to pressure contact with projections formed on peripheral surfaces of said scribing rolls to impart said scribing to said different portions of the strip as the strip is advanced passed said scribing rolls, including arranging said projections in a predetermined spaced apart relation, supporting the strip while being scribed by rotatable anvil rolls for each row of scribing rolls arranged to contact and support the side of the strip opposite said one side thereof, in which said anvil rolls possess substantially greater resistance to deflection than said scribing rolls, causing said strip to move between said scribing rolls and said anvil rolls and maintaining at least one of said scribing rolls in a selected orientation relative to said side of the strip to be scribed in a manner to enhance in guiding the strip during its movement and in obtaining a desired scribing effect by said at least one scribing roll, applying a selective loading to at least one of said scribing rolls and selectively controlling said loading applied to said scribing rolls subject to said loading, and cooling said scribing and anvil rolls in a manner to control the thermal radial expansion of said scribing and anvil rolls.

* * * * *